United States Patent [19]

Thuleen et al.

[11] 4,082,078

[45] Apr. 4, 1978

[54] PYROLYTIC LOCK ASSEMBLY

[75] Inventors: Richard A. Thuleen, Minneapolis; John E. Richard, Buffalo, both of Minn.

[73] Assignee: Litton Systems, Inc., Beverly Hills, Calif.

[21] Appl. No.: 730,229

[22] Filed: Oct. 6, 1976

[51] Int. Cl.[2] ..... F23M 7/00; E05C 3/02

[52] U.S. Cl. ..... 126/197; 292/201; 292/DIG. 69; 126/19 R; 219/392

[58] Field of Search ..... 126/197, 19 R; 292/144, 292/108, 210, 201, DIG. 69, 128

[56] References Cited

U.S. PATENT DOCUMENTS

| | | | |
|---|---|---|---|
| 2,741,505 | 4/1956 | Courney | 292/128 |
| 2,898,138 | 8/1959 | Van Noord | 292/201 X |
| 3,099,471 | 6/1963 | Scott et al. | 126/197 X |
| 3,317,708 | 5/1967 | Bowling | 292/DIG. 69 |
| 3,733,456 | 5/1973 | Blackburn | 292/201 X |
| 3,859,979 | 1/1975 | Gilliom | 292/DIG. 69 |
| 3,912,904 | 10/1975 | Phifer | 126/197 X |

*Primary Examiner*—Kenneth W. Sprague
*Assistant Examiner*—Larry Jones
*Attorney, Agent, or Firm*—Robert E. Lowe

[57] ABSTRACT

A lock assembly for a domestic cooking appliance for use during a pyrolytic self-cleaning operation. The assembly includes a pair of cams mounted on a common shaft which provide the dual functions of energizing and de-energizing certain switches in the operating circuit as well as mechanically engaging and locking certain door latch components. The cams are rotated into and out of the locked and unlocked positions by a single lock motor.

5 Claims, 5 Drawing Figures

FIG. 1
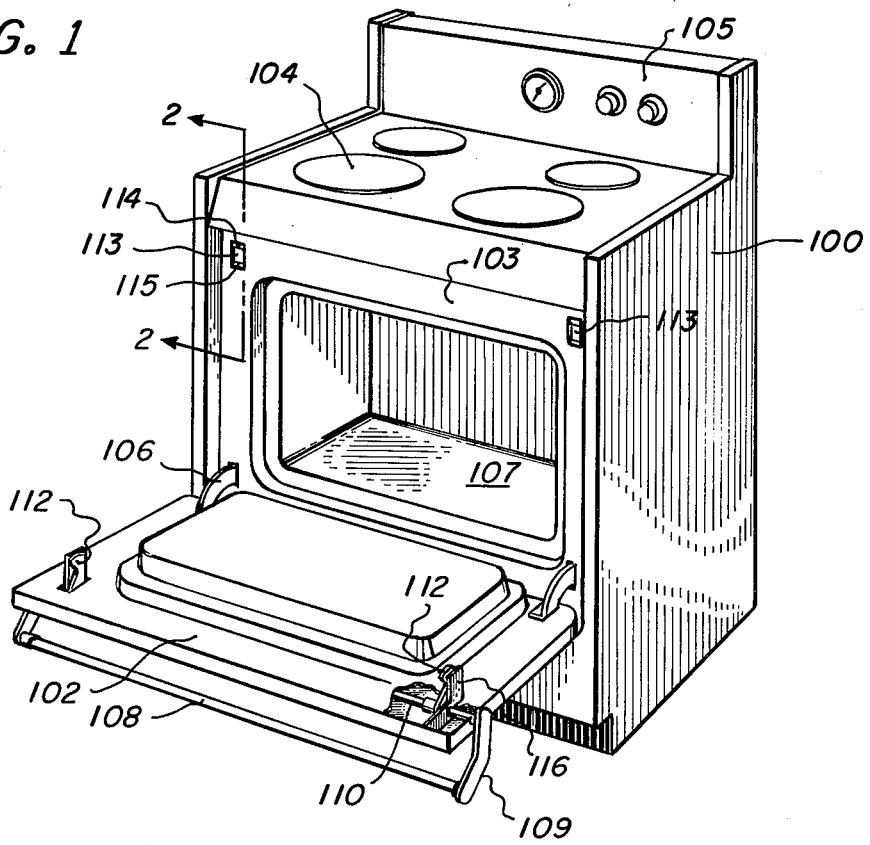
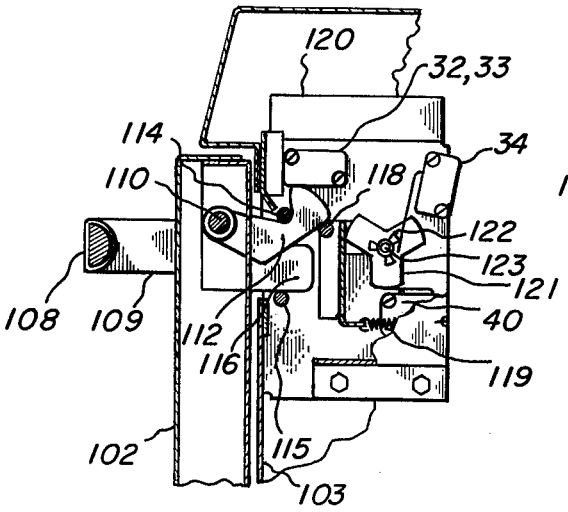
FIG. 3
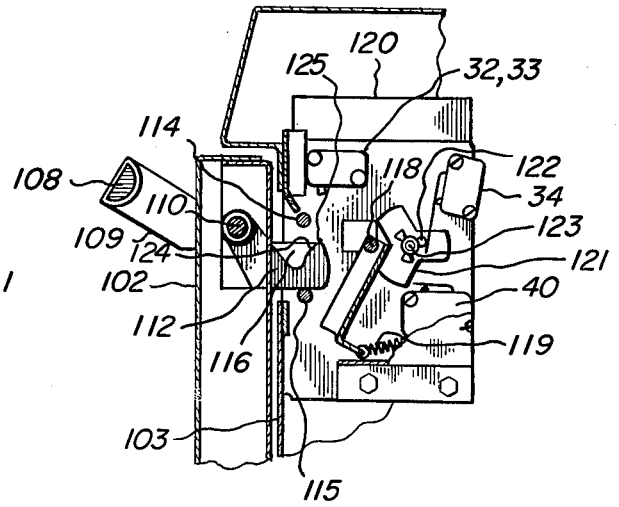
FIG. 2

PYROLYTIC LOCK ASSEMBLY

BACKGROUND OF THE INVENTION

This invention relates to the field of domestic cooking ranges, and more particularly to such ranges having a pyrolytic self-cleaning capability. The invention is directed to a door lock assembly for such appliances, and the assembly is especially adapted for use in an appliance having both a pyrolytic self-cleaning capability and a microwave cooking capability.

Domestic ranges having a heat cleaning or a pyrolytic self-cleaning capability are well known. Such ranges use the technique of heating the oven cavity to temperatures substantailly in excess of those encountered in normal cooking, typically above 750° F. Because of the high temperatures involved in such operations, it is a safety requirement that the oven door be securely locked and not be openable while such temperatures exist in the oven. A variety of locks to accomplish this purpose have been suggested in the prior art.

While pyrolytic oven lock mechanisms have been previously known, they have been less than fully satisfactory. The cost and complexity of manufacture as well as reliability are areas in which improvement is required.

Moreover, domestic cooking appliances which have the capability of performing both conventional cooking and microwave cooking in a single cavity have now been made available to the consumer. In such an appliance the door lock assembly must serve not only to provide the necessary locking functions during pyrolytic self-cleaning but must also provide for safe and reliable operation in the microwave cooking mode.

SUMMARY OF THE INVENTION

It is therefore an object of the present invention to provide a pyrolytic door lock assembly for a domestic cooking appliance which assembly is reliable and simple to manufacture.

A further object of the invention is to provide a lock assembly for a self-cleaning range door which assembly is adapted to provide the necessary interlock functions in a mode of microwave cooking.

The invention provides a cooking appliance door having a handle rotatable in an approximately vertical plane. Secured to the handle and rotatable therewith are a pair of engaging hooks located in the upper corners of the door, said hooks being engaged by a strike mechanism upon downward rotation of the door handle. A locking bar adapted to engage the hooks to hold them in a closed and locked position is in turn held in place by a rotatable cam which serves the dual function of mechanically locking the door and activating sensing switchs to control the lock and clean functions of the cooking appliance. The entire assembly can be bracket mounted for installation into the cooking appliance.

DESCRIPTION OF THE DRAWINGS

The invention will be further described by reference to the accompanying drawings in which:

FIG. 1 is a perspective view of a cooking appliance having the lock assembly mechanism of the present invention.

FIG. 2 is a partial section view of the lock assembly taken along line 2—2 on FIG. 1 showing the lock assembly in a first position.

FIG. 3 is a partial section view of the lock assembly taken along line 2—2 in FIG. 1 showing the lock assembly in a second position.

DESCRIPTION OF PREFERRED EMBODIMENTS

Figure 4:
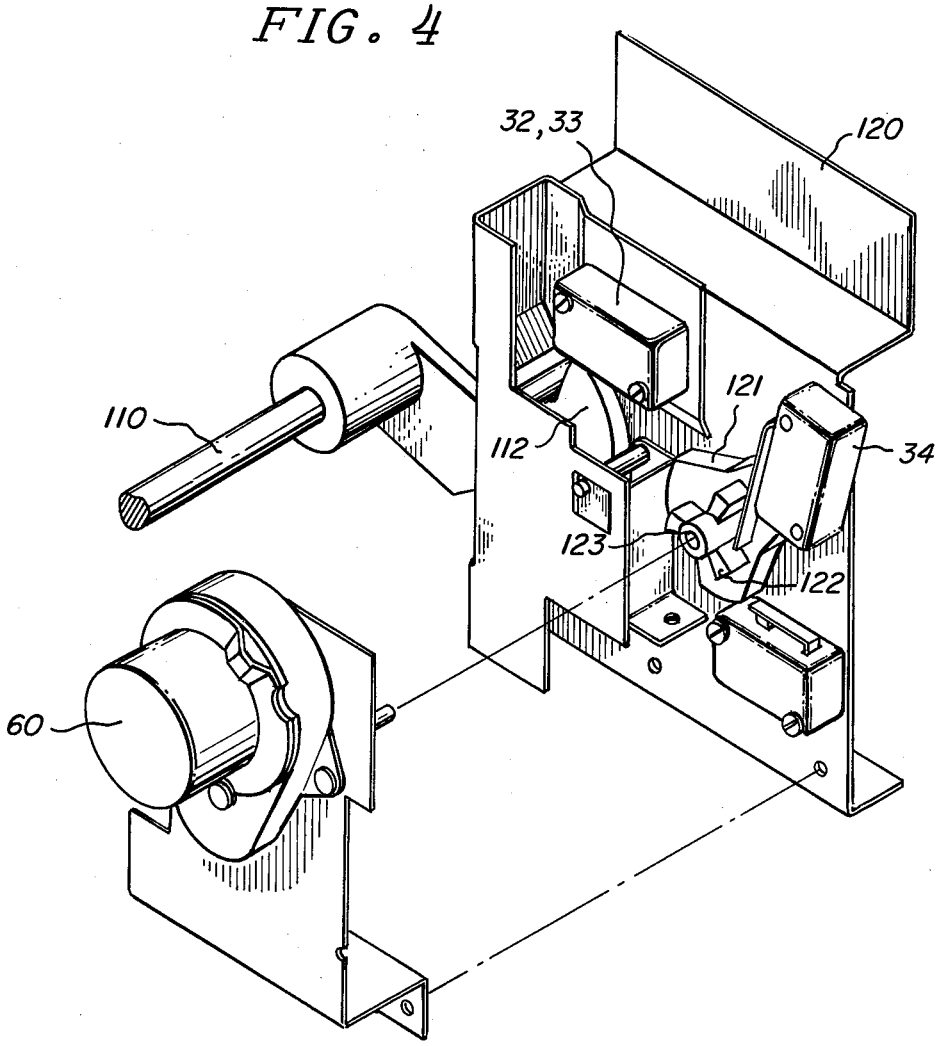
FIG. 4 is an exploded perspective view of the lock assembly of the present invention.

A domestic cooking appliance 100 is shown in FIG. 1 having a door 102 and front panel 103. The appliance includes a number of conventional surface burner elements 104 and a control panel 105.

The door 102 is mounted to the appliance 100 by means of hinges 106 located at the lower corners of the door and about which the door can be rotated between open and closed positions. In its closed position door 102 fully covers and seals cooking cavity 107.

Doorhandle 108 is operably mounted to the door 102 and includes end portions 109 and shaft 110 connected there between. Locking hooks 112 are fixed to shaft 110 for rotation therewith upon the rotation of handle 108.

Apertures 113 are provided in the front portion 103 of the appliance, the apertures being located so as to receive the locking hooks 112 when the door is placed in a closed position. A locking roller 114 can be seen in the upper portion each aperture 113, and a guide roller 115 can be seen in the lower portion of each of the apertures. Guides 116 are mounted on shaft 110 outwardly of the locking hooks 112, the guides serving to engage and ride on the guide rollers 115 in order to properly position the door in the closed position.

FIG. 2 shows a partial section of the lock assembly with the door in the closed but unlocked position. The handle 108 is in its uppermost position and guides 116 are resting upon guide rollers 115.

As handle 108 is rotated downwardly into the position shown in FIG. 3, locking hooks 112 are rotated upwardly. As the locking hooks move upwardly the cam surfaces 124 of the locking hooks engage the locking rollers 114. The reaction of the rollers 114 on the cam surfaces of the locking hooks 112 pulls the door 102 in snug engagement with the front panel 103. The handle 108 continues downward travel until the cam surfaces of the locking hooks 112 reach the limit of their travel, at which point the door 102 can no longer be pulled open without first rotating the handle upwardly to the unlocked position.

Figure 5:
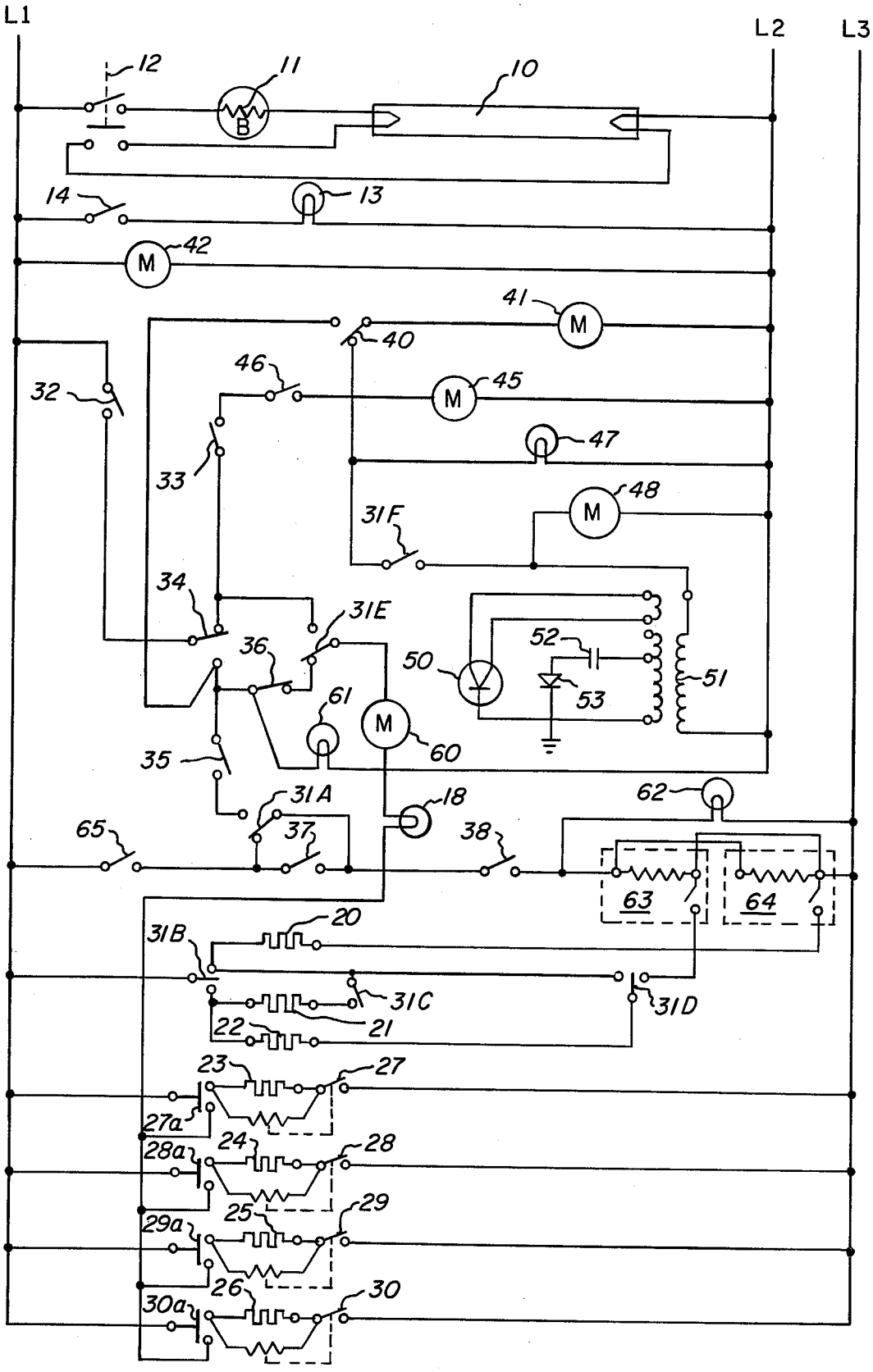
FIG. 5 is an electrical schematic of the operating circuit of the cooking appliance shown in FIG. 1.

The apex 125 of the locking hooks 114 engages switchs 32 and 33 closing the switchs and providing a signal that the door is in a locked position as is shown in the schematic diagram in FIG. 5. It will be understood that switchs 32 & 33 are identical and that one is located at the left side of the door locking mechanism and the other is located at the right side for respective engagement with locking hooks 112. The precise operation of the above described portion of the door locking system is described more fully in copending patent application Ser. No. 707,863 entitled "Oven Door Latch" and assigned to the assignee of the present application.

As the locking hooks assume the full upward position as shown in FIG. 3 the lock lever assembly 117 engages the rear surface of the locking hooks 112 being moved into position by action of the spring 119. The locking bar 118 of the lock lever assembly bears against the rear surface of the locking hooks providing some opposition to the movement of the hooks into an unlocked position.

The various components of the door lock assembly are preferably mounted to a support bracket 120 to form integral unit. Mounted at one side of the bracket is a motor 60 having a corresponding shaft 123. Concentrically mounted to the shaft 123 are a pair of cams 121 and 122 each having three cam lobes each of the lobes being positioned approximately 120 ° from an adjacent cam lobe. The large cam 121 and the small cam 122 are mounted on the shaft in such a way that their respective lobes are offset so that the cam lobes of large cam 121 leads the corresponding cam lobe of small cam 122. This relationship is shown clearly in the exploded view of FIG. 4.

When the motor 60 is energized it rotates its shaft and the cams 121 and 122 in a counter clockwise direction as viewed from the shaft end. The cams are rotated until such time as one cam lobe of the large cam 121 is positioned directly behind lock lever assembly 117, thereby preventing the lock lever assembly from moving rearwardly to disengage the locking hooks 112. With the cam 121 so positioned, the locking bar 118 is held in position against hooks 112 preventing their rotation to an unlocked position. The specific operation of the cam lobes and the associated switchs will be explained in further detail with reference to both FIGS. 4 and the schematic of FIG. 5.

With the oven door 102 in the closed position and the handle 108 in the downward position, the locking hooks 112 will have engaged the switchs 32 and 33 causing them to be closed. A selector switch located on the control panel 105 for selecting the various modes of operation of the appliance is then operated to select the "clean" position. This closes switch 31E to its uppermost contact supplying power to the lock motor 60. The remaining contacts of the selector are at the same time positioned as follows: Switch 31A is closed to the left contact shown, switch 31B to its lower contact, switch 31C is closed, switch 31D is closed to its left contact, and switch 31F is open.

With the closing of switch 31E the motor 60 rotates cams 121 and 122 approximately 60° counter clockwise. At the end of such rotation one of the cam lobes of cam 122 will have engaged the switch 34 moving it to the lower contact as shown in FIG. 5, and at the same time one of the cam lobes of cam 121 will have engaged switch 40 transferring it to the upper contact shown in FIG. 5. The transfer of switch 34 interrupts power to the motor 60 and terminates the rotation of the cams. The closing of switch 40 to its upper contact initiates power for the clean cycle. The electrical operation of such cycle is described in more detail in copending patent application Ser. No. 717,817 filed Aug. 26, 1976 entitled "Oven Blower Interlock Circuit" and assigned to the assignee of the present application.

Upon completion of the cleaning cycle and after sufficient time has elapsed to allow the interior of the cavity 107 to return to a safe temperature level, the selector switch on control panel 105 may be placed in its "off" position. This causes switch 31E to be transferred to its lower contact thereby supplying power motor 60 through switch 40, switch 36 and switch 31E. The motor 60 then rotates counter clockwise through approximately 60 degrees of rotation whereby switch 40 is allowed to return to its normally closed lower contact and switch 34 is disengaged and allowed to return to its normally open upper contact, thereby once again stopping the rotation of motor 60. Such rotation also moves the large cam lobe of cam 121 out of engagement with lock lever assembly 117. The handle 108 can now be rotated in an upward position, the cam action of the rear surface of locking hooks 112 driving the locking bar 118 of the lock lever assembly rearwardly and allowing the locking hooks to be disengaged so that the door can be opened.

The remainder of the operating schematic shown in FIG. 5 is included for purposes of completeness and clarity, but does not directly affect the operation of the locking mechanism described herein. The circuit includes a florescent light 10 for lighting the surface of the range, the florescent light being operated by a ballast 11 and a momentary start switch 12. An oven light switch 14 is included for lighting an oven light 13. Motor 42 operates the range timer while motor 41 operates a blower mechanism for cooling various components during operation.

As has been heretofore indicated the appliance 100 is preferably of a type adapted to a cook using both conventional thermal heating as well as microwave energy. Accordingly, a microwave circuit is included which includes magnetron 50, power transformer 51, capacitor 52, and diode 53, which have been electrically interconnected to form a half wave doubler power circuit. The microwave portion of the circuit also includes a microwave timer motor 45 with its associated switch 46, an indicator light 47 and a microwave energy stirrer motor 48. Contacts 31F of the selector switch operate to bring the microwave portion of the circuit into and out of operation upon appropriate selection.

Conventional heating elements are provided for operation of the range including a broil element 20, bake elements 21 and 22, as well as surface elements 23, 24, 25, and 26. Each of the surface elements are adapted to be operated by their respective switches 27, 28, 29 and 30; with switches **27*a*, 28*a*, 29*a*, and 30*a* being provided to operate a surface indicator light 18 to give a visual indication that one or more of the surface elements are in operation. The indicator lights for the appliance also include a clean indicating light 61 which is illuminated during the clean cycle, as well as an oven indicator light 62 which is illuminated during operation of the oven. Thermal relays 63 and 64** are provided to transfer power to the surface elements and the oven heating elements.

Thus it can be seen that the mechanism described herein provides a simple and reliable method of locking the appliance oven door during a clean cycle. The locking hooks 112 themselves commence the operation as they are rotated into the locked position closing switches 32 and 33. Following the door closing and locking sequence selection of the "clean" cycle operates the lock motor 60 to drive the cams 121 and 122 into position to hold the lock lever assembly into engagement with the locking hooks. This action insures that the door cannot be opened during the clean cycle of operation.

While in the foregoing specification the invention has been described in considerable detail, it will be understood that such detail is for the purpose of illustration and not by way of limitation. The full scope of the invention is, of course, defined in the appended claims and those skilled in the art can make various modifications and additions without departing from the spirit or scope of those claims.

We claim:

1. A locking mechanism for a domestic cooking appliance having a pyrolytic cleaning circuit, said appliance having a door, said door including a movable handle portion with latch elements; said appliance having means for receiving and engaging said latch elements when said door is closed, said mechanism comprising:

first and second cams mounted for rotation on a common shaft; means for rotating said cams; means for control of said rotating means; a lock element positionable to prevent movement of said latch elements and opening of said door during a pyrolytic cleaning mode of operation; switch means for energizing said pyrolytic cleaning circuit; said first cam adapted to simultaneously engage said lock element and said switch means, said second cam adapted to engage or disengage said control means at preselected rotational intervals.

2. The apparatus of claim 1 wherein said rotating means comprises an electric motor, said cams being mounted on said motor shaft.

3. The apparatus of claim 2 wherein said control means includes a switch engageable by said second cam, said switch opening and closing a circuit providing power to said motor.

4. The apparatus of claim 1 wherein said preselected intervals are approximately 60 degrees.

5. In a kitchen range having a pyrolytic cleaning mode of operation, and including a door having a rotatable handle portion having latch hook elements mounted to rotate in response to the rotation of said handle, said range including means for receiving and engaging said latch hooks when said door is closed, the downward rotation of said handle portion causing said door latch hooks to rotate into a locked configuration, the improvement comprising:

a lock element positionable to prevent door latch hooks from being rotated to an unlocked configuration; first and second cams mounted for rotation on a common motor shaft, said motor having a switch for energizing and de-energizing said motor; means for activating said pyrolytic cleaing mode; whereby selection of said pyrolytic cleaning mode energizes said motor and rotates said cams to a position wherein said first cam bears against said lock element and against said pyrolytic activating means, and said second cam engages said motor switch to de-energize said motor to stop further rotation of said cams.

* * * * *